United States Patent [19]

Snyder et al.

[11] Patent Number: 5,010,905

[45] Date of Patent: Apr. 30, 1991

[54] WATER-VAPOR HAIR TREATMENT APPARATUS

[76] Inventors: Marilyn J. Snyder, 1185 Park Ave., New York, N.Y. 10028; Susan Bjurman, 969 Hilgard Ave., Los Angeles, Calif. 90024

[21] Appl. No.: 424,612

[22] Filed: Oct. 20, 1989

[51] Int. Cl.[5] ..... A45D 19/16

[52] U.S. Cl. ..... 132/272; 132/212; 4/537; 261/DIG. 48

[58] Field of Search ..... 132/203, 206, 207, 211, 132/212, 271, 272, 333; 4/535, 537; 261/DIG. 48, 142; 219/310, 312, 319, 326, 362

[56] References Cited

U.S. PATENT DOCUMENTS

| | | | |
|---|---|---|---|
| 1,832,360 | 11/1931 | Clemenger | 132/212 |
| 1,847,619 | 3/1932 | Mascolo | 4/537 |
| 2,133,638 | 10/1938 | Singerman | 132/272 |
| 3,281,864 | 11/1966 | Linnehan | 4/537 |
| 3,511,236 | 5/1970 | Conlin et al. | 261/142 |
| 3,733,060 | 5/1973 | Merritt | 261/DIG. 48 |
| 3,749,092 | 7/1973 | Williams | 4/537 |
| 3,814,111 | 6/1974 | Doyle et al. | 132/272 |
| 3,947,659 | 3/1976 | Ono | 219/362 |
| 4,114,022 | 9/1978 | Braulke, III | 219/362 |
| 4,257,989 | 3/1981 | Nishikawa | 261/DIG. 48 |
| 4,314,138 | 2/1982 | Itoh | 261/142 |
| 4,431,041 | 2/1984 | Leiserson | 224/908 |
| 4,640,804 | 2/1987 | Mizaguchi | 261/DIG. 48 |
| 4,641,053 | 2/1987 | Takeda | 261/DIG. 48 |
| 4,663,091 | 5/1987 | Seo | 261/DIG. 48 |
| 4,708,826 | 11/1987 | Mizoguchi | 261/DIG. 48 |
| 4,719,057 | 1/1988 | Mizoguchi | 261/DIG. 48 |
| 4,752,422 | 6/1988 | Uchida et al. | 261/DIG. 48 |

FOREIGN PATENT DOCUMENTS

| | | | |
|---|---|---|---|
| 260149 | 3/1912 | Fed. Rep. of Germany | 4/535 |
| 56-13557 | 3/1981 | Japan | 261/DIG. 48 |

*Primary Examiner*—John J. Wilson
*Assistant Examiner*—F. LaViola
*Attorney, Agent, or Firm*—Sherman and Shalloway

[57] ABSTRACT

Disclosed is an apparatus for treating moisture-depleted hair with water vapor. The apparatus is constructed so as to be very convenient to the user in treating his or her hair. It includes a first base section which can be a table top unit or a wall mounted unit, and a flexible and collapsible hose portion which is connected to the base section and adapted to be maneuverable by the subject so as to be positionable in an infinite array of directions. The base section includes a removable water reservoir chamber and a housing which includes a vapor generation section as well as an airflow section. A fan is provided in order to entrain water vapor which may be produced by way of either an ultrasonic vibrator or heating coils, and force them out through the flexible hose and onto the subject's head. A variety of interchangeable nozzles are adapted for use on the end of the flexible hose, and are configured in a variety of shapes so as to provide the user with great flexibility in their hair care method. Supplementary heating coils may be provided for use with the ultrasonic vibrator so as to host the airflow and provide a heated water vapor to the subject's head.

22 Claims, 4 Drawing Sheets

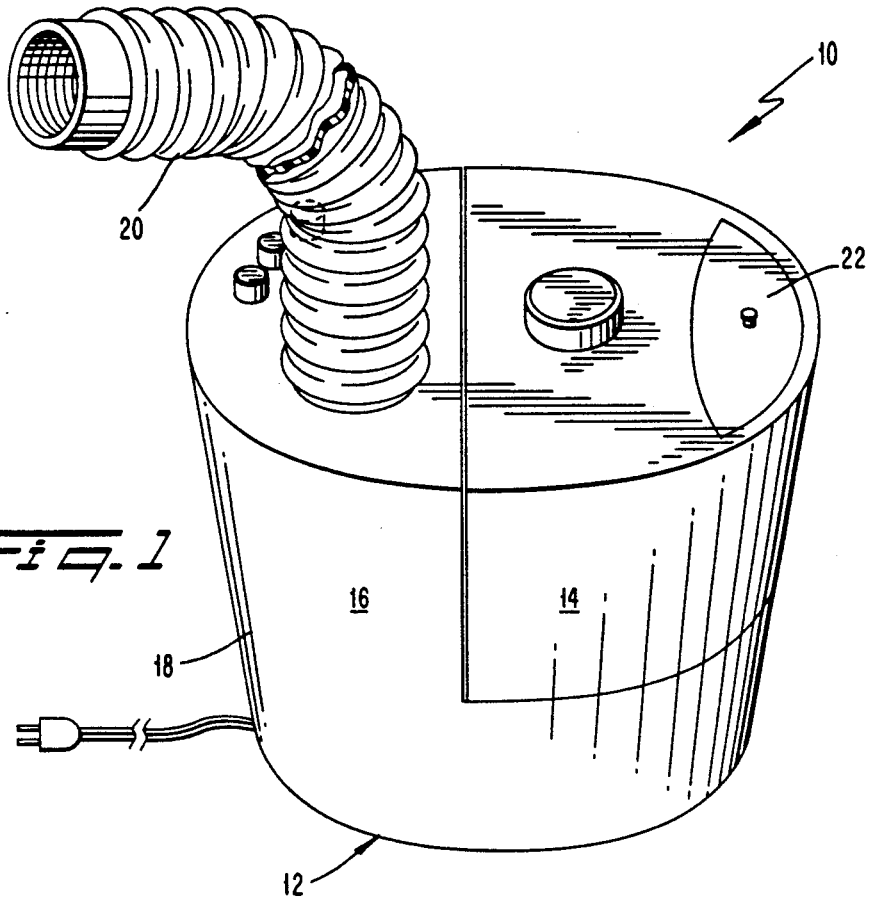
Fig. 1
Fig. 6A
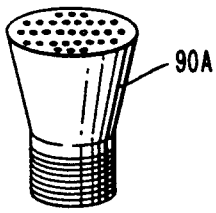
Fig. 6C
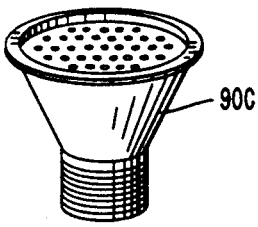
Fig. 6B
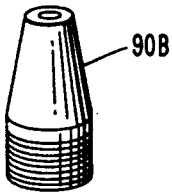
Fig. 6D
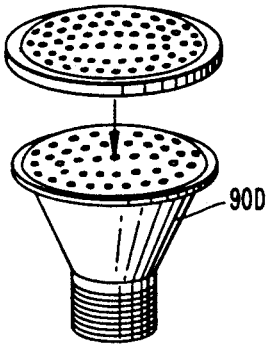
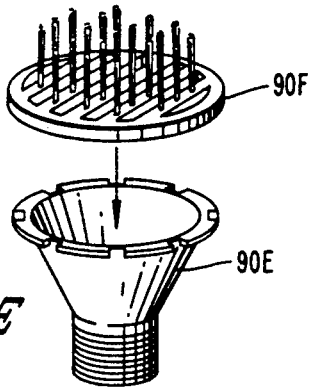
Fig. 6E

WATER-VAPOR HAIR TREATMENT APPARATUS

BACKGROUND OF THE INVENTION

1. Field Of The Invention

The present invention relates generally to an apparatus for treating the hair with water vapor and more specifically to an apparatus, for treating hair with water vapor, which includes a main base unit and a flexible hose for transferring vapor from the main unit to the subject's hair in the desired manner.

2. Description Of The Prior Art

The overall appearance a person presents is a significant factor in forming and retaining business and social relationships, as well as in maintaining a high level of self-confidence. The condition and aesthetic appearance of a person's hair lends greatly to the overall appearance they portray. Often times, a person's hair appears unkempt, unmanageable and less than healthy looking due to the fact that the hair has become moisture-depleted. Many factors such as time, climate, environment, stress and travel, may lend to the moisture-depletion of hair.

People spend a great deal of time on different hair-care methods such as blow-drying, curling and conditioning the hair with chemical conditioners, but these types of hair-care may be potentially damaging and are often time consuming and skill demanding in their use.

Various prior art devices have been proposed which treat the hair with steam as the hair is being dried by way of a blow-dryer. For example, U.S. Pat. Nos. 3,947,659 to Ono and 4,114,002 to Braulke, III disclose portable hand-held hot air blow-dryers each of which includes means for impinging steam on the subject's hair as it is being blow-dried with hot air. As these devices include, in their single hand-held housing, all of the necessary mechanisms for creating and supplying a flow of hot air as well as for creating and supplying a flow of steam, they may become quite heavy and difficult to maneuver. This problem is accentuated when it is desired to comb or otherwise treat the subject's hair while utilizing the dryer/steamer. Furthermore, it is not always desirable to utilize hot air blow-drying of the hair at the same instant as the hair is treated with the water vapor. These prior art devices thus have the disadvantage of combining the hair dryer mechanisms and steaming mechanisms in a single hand-held housing such that the device becomes heavy and cumbersome. Further, the Braulke, III device is not adapted to provide the hair with steam treatment exclusive of hot air treatment.

A further example of a combined hair dryer and hair moisturizer apparatus is disclosed in U.S. Pat. No. 3,814,111 to Doyle, et al. This apparatus is large, cumbersome, and advantageous only if the user wishes to be seated and have his or her entire head surrounded by a head plenum. This device provides both steam and heat, but cannot be utilized to treat only portions of the subject's hair as the steam and/or heat is applied around the entirety of the subject's head.

SUMMARY OF THE INVENTION

It is thus a primary object of the present invention to advantageously provide a hair treating apparatus for applying steam or other water vapor to the subject's hair in order to restore freshness and body to hair that has been moisture-depleted.

A further object of the present invention is to provide a device for applying moisture to a person's hair without the inherent disadvantages of the prior art devices.

A still further object of the present invention is to provide a device, for treating hair with water vapor, which is easily maneuverable and useful during grooming and the like.

Yet another object of the present invention is to provide an apparatus which is usable to treat a subject's hair with various hair care products at the same time as the hair is being treated with steam or other water vapor.

The present invention is designed to restore freshness and body to hair that has been moisture-depleted by any of various factors including time, climate, environment, stress and travel. By the use of water-vapor, as apposed to conventional hair care methods such as use of dry air blow-dryers, curlers and chemical conditioners, the use of which are time consuming, skill demanding and potentially damaging to the subject's hair, the present invention quickly restores moisture to the hair; thus providing improved manageability and conditioning of the hair.

The present apparatus which is utilized to provide water-vapor treatment of the hair, comprises a first base section and a second delivery section. The base section includes a housing for containing a water reservoir, a vapor generation section for generating water vapor and a control portion for selectively supplying the vapor to the delivery section. The delivery section includes a flexible and collapsible hose which is adapted to connect at one end with the base section and a plurality of interchangeable nozzles connectable to the free end of the flexible and collapsible hose for presenting and delivering the vapor to the subject's hair in a desired fashion.

Although the primary pupose of the present invention is for use in treating moisture-depleted hair, because various interchangeable nozzle attachments cn be easily provided, the apparatus may also be used for purposes other than hair treatment. For example, a mask which fits over a person's mouth and/or nose may be provided so as to utilize the water-vapor apparatus as a "vaporizer" for delivering water-vapor to the user's nasal passages in order to reduce nasal congestion due to colds, influenza and allergies. A hand held hose/nozzle version may also be used as a spot facial steamer. This would be appropriate for users who wished to steam specific facial areas or for those individuals who have an aversion to covering their entire face with a mask.

BRIEF DESCRIPTION OF THE DRAWING FIGURES

The present invention will now be more fully described in connection with the accompanying drawing figures, in which:

FIG. 1 is a perspective view of the inventive apparatus;

FIGS. 6A through 6E show elevation views of alternative interchangeable nozzles adapted for use in the present invention;

DETAILED DESCRIPTION OF THE INVENTION

Figures 2, 5:
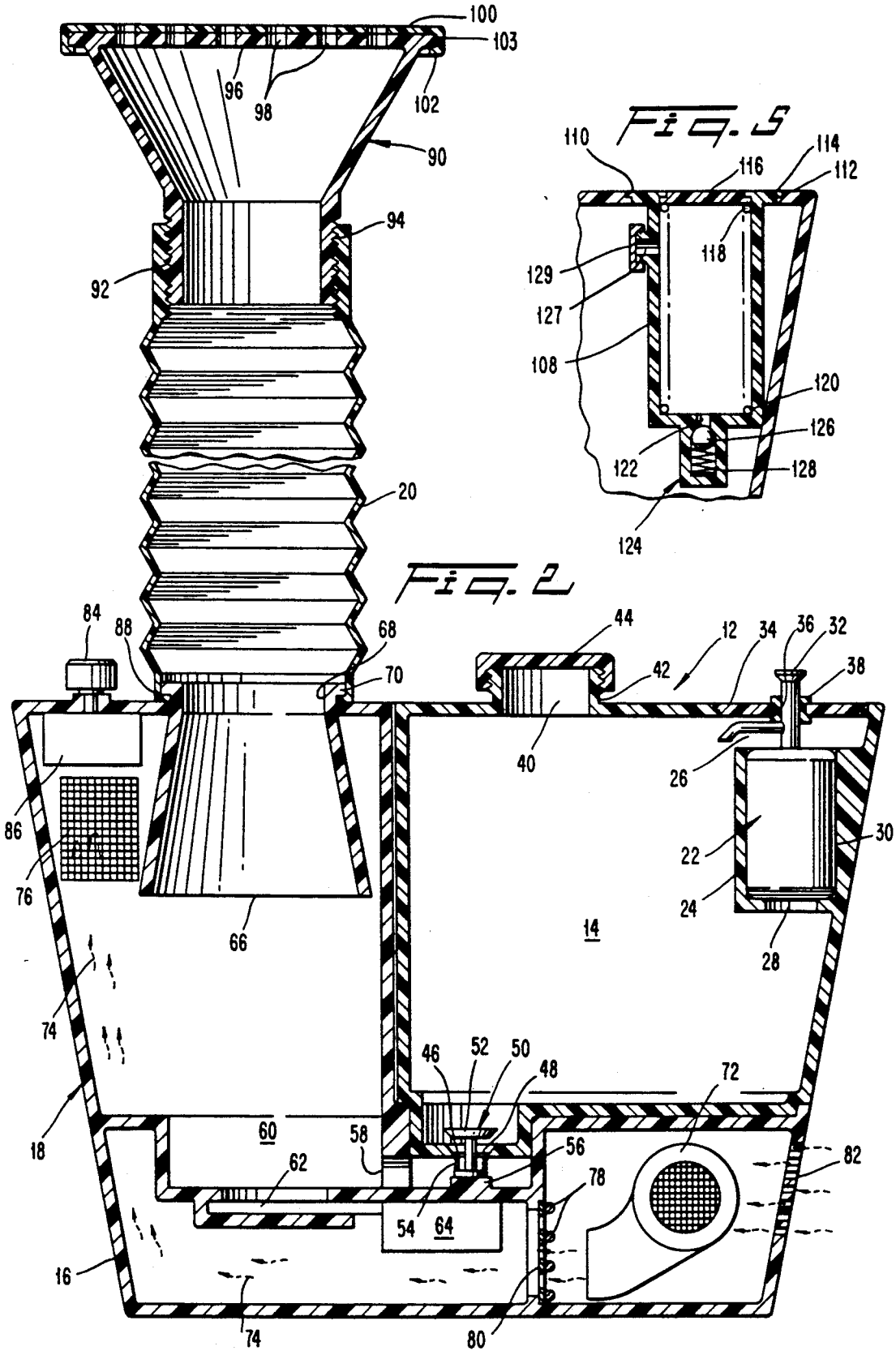
FIG. 2 is a cross-sectional elevation view taken along line II—II of FIG. 1.
FIG. 5 shows an alternative arrangement for a portion of the inventive apparatus usable for either of the embodiments shown in FIGS. 2 and 4.
Figure 3:
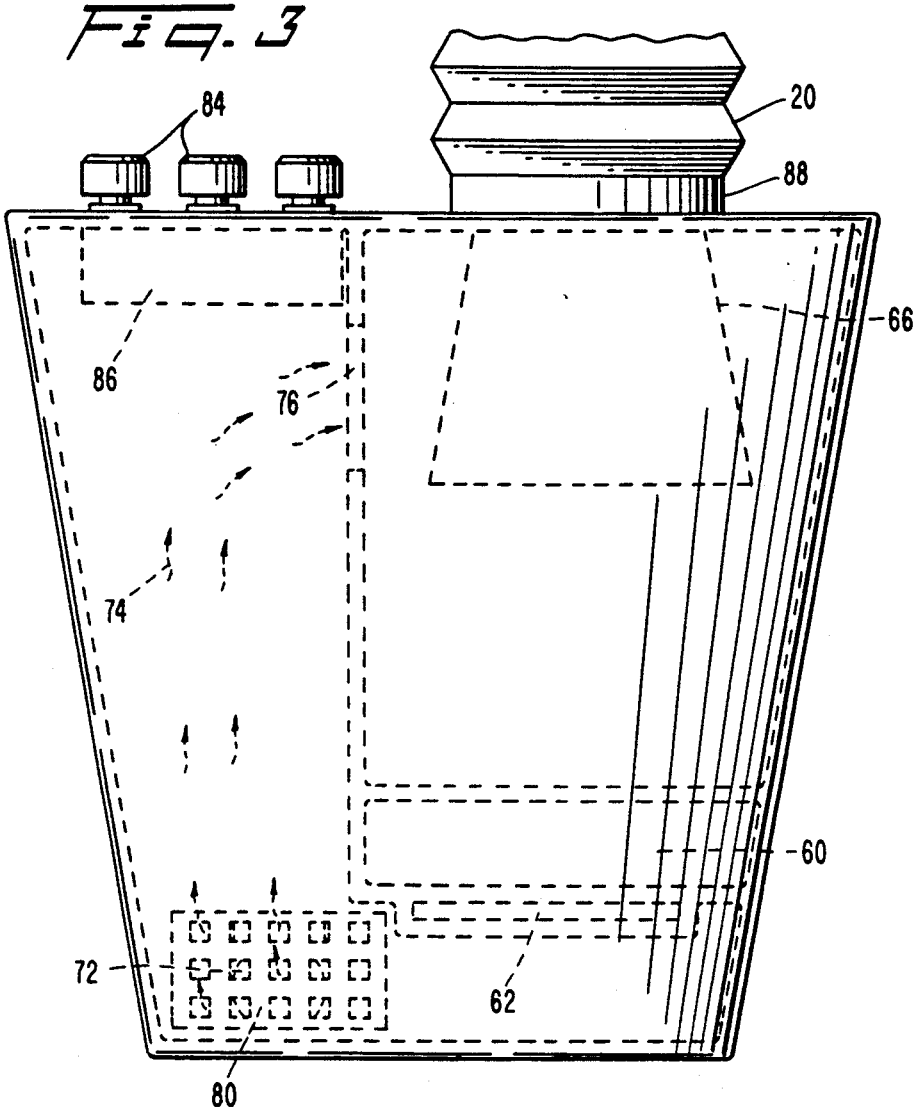
FIG. 3 is a left end view of the apparatus shown in FIG. 2.

Referring first to FIGS. 1-3, a first preferred embodiment of the water-vapor hair treatment apparatus of the present invention is shown at reference numeral 10. The water-vapor hair treatment apparatus comprises a base section 12, which includes a removable water reservoir 14 which is shaped to fit into a cutout portion of housing 16 of the base section and a vapor generation section 18, and a delivery section which includes a flexible and collapsible delivery hose 20. As shown best in FIG. 2, the water reservoir section 14 includes a hair care product dispenser section 22.

This hair care product dispenser section is defined by contoured support walls 24 spanning an upper corner of the water reservoir chamber. A first dispensing opening 26 is formed in an upper portion of the support walls 24, and a lower drain opening 28 is formed in a lower portion of the support walls 24 and allows any water which enters the dispenser section to drain back into the water reservoir. A manually actuable hair care products dispenser 30 is adapted for receipt within the support walls 24 of the hair care products dispensing section. This dispenser 30 is a manual pump type dispenser which is convertible except that it is contoured to conform in shape to the inside of the support walls 24. The dispenser includes an actuator button 32 which is vertically elongated so as to protrude upwardly through the top of the water reservoir chamber. The dispenser is removable from the support walls 24 by removing the closure member 34 sized to fit into the hair care product section opening which is contoured similar to the shape of the dispenser 30. The closure member 34 includes a centrally disposed aperture therein adapted for slidable receipt of the actuator button 32 of the dispenser 30. A gasket 38 is disposed about the inner periphery of the opening to prevent leakage of water from the reservoir 14. Although the closure member 34 may be sealed in a variety of manners onto the opening of the dispensing section, it is preferred that the closure member be formed of a slightly flexible rubber like material and include flanges corresponding to flanges formed in the dispensing section opening.

The water reservoir 14 is provided with a water fill hole 40 provided in the top of the water reservoir chamber. An externally threaded circular flange 42 is formed integrally with the top surface of the water reservoir chamber 14 and surrounds the water fill hole 40. A fill cap 44 is provided and includes internal threads for threading onto the external threads of flange 42.

Shown at 46 is a water outlet port formed in the bottom portion of the water reservoir chamber 14. A narrow cross-support 48 is formed across the water outlet port 46 and forms part of an outlet port valve 50. The outlet port valve also includes a valve body 52, a helical compression spring 54 disposed between a bottom flange of the flange body 52 and the narrow cross-support 48. The valve body is normally biased shut due to the downward bias force of spring 54 against the lower flange portion of the valve body 52. An upper closure portion of the valve body 52 corresponds in shape to the outlet port 50 and seals the same when the valve is biased shut. Upon placement of the water reservoir chamber 14 in the cutout provided in housing 16, the lower portion of the valve body 52 is pressed upwardly against the spring bias by an actuation protrusion 56 formed in the housing 16. As the valve 50 is opened when the water reservoir 15 is seated in its cutout, water from the water reservoir is free to flow through the outlet port 46 and through water passageway 58. The water then enters a secondary water chamber 60 formed in the vapor generation section of the base 12. The water is then in contact with an ultrasonic vibrator 62 disposed in a bottom portion of the secondary water chamber 60. The ultrasonic vibrator 62 is connected to control circuitry 64 which is conventional and is not considered a distinguishing feature of the present invention. Although a preferred embodiment of outlet part valve, 50 is shown and described, it is contemplated that any suitable valve may be used.

Spaced directly above the ultrasonic vibrator 62 is an inverted funnel shaped vapor collecting shroud 66. This shroud 66 provides that a significant portion of the water vapor is collected and delivered to the vapor outlet 68 formed in the upper surface of the housing 16. A circular flange 70 is formed about the circumference of the vapor outlet and extends above the surface of the housing 16. This flange 70 is adapted to receive a connector end of the flexible and collapsible hose 20.

In order to provide a steady airflow, and thus a forced delivery of vapor through the flexible hose and onto the subject's hair, a fan 72 is provided and is disposed within the housing 16 the area of beneath cutout for the water reservoir 14. The airflow is directed through an airflow channel which is depicted by arrows 74. An opening 76, which may include a grating thereover, is arranged in the wall separating the airflow channel and the vapor generation section. This allows the airflow to enter the vapor generation section 18, and entrain the water vapor and carry it upwardly through the vapor outlet 68, through the flexible hose 20 and to the subject's hair.

As the ultrasonic vibrator 62 does not utilize heat in order to form water vapor, but rather utilizes ultrasonic vibrations to agitate water and form an extremely fine mist, the water vapor produced by the apparatus will be a cool water vapor rather than heated water vapor (e.g. such as steam). Because it is often desirable that the water vapor applied to the subject's hair be heated to various extents, it is contemplated in the present invention that heating coils 78 be provided. These heating coils 78 are preferably arranged proximate the outlet of the fan 72 and supported in a vertical fashion by way of metal grating 80 which is connected between upper and lower portions of the airflow channel. An air inlet 82 for the fan is formed in the housing 16 adjacent the rear end of the fan 72. This inlet 82 is preferably integrally formed with the housing 16.

Manual control means such as dials 84 or any other suitable means, are provided for adjustably controlling the various electrical elements of the steam apparatus.

These controls 84 will provide adjustability for the fan 72, the heating coils 78, and the ultrasonic vibrator 62. Although the electrical circuitry utilized to provide adjustability to these various electrical elements by way of controls 84 may be any suitable conventional electrical circuitry, it is contemplated that the controls 84 will utilize a standard variable resistance type rheostat circuitry.

The flexible hose 20 includes, at its lower end, a connector portion 88 for connecting the flexible hose to the flange 70 which surrounds the vapor outlet 68. Although the flange 70 and connecting element 88 of flexible hose 20 are adapted to connect with one another in a snap-fit type connection, it is contemplated that various types of connections such as a slot and key type connection may be utilized.

The flexible hose 20 is provided at its free end with an internally threaded nozzle connection 92 which is adapted to accommodate an externally threaded connection portion 94 of an interchangeable nozzle 90. Note that the interchangeable nozzle 90 shown in FIG. 2 is but one of a plurality of various interchangeable nozzle configurations which may be employed in the invention, as will described hereinafter. The exit portion of the nozzle 90 is covered by a plate 96 which may or may not be integrally formed with the remainder of the nozzle 90. Formed in the jet plate 96 are numerous spaced jet holes 98 which cause jets of water vapor to be formed and impinge upon the subject's hair. A jet adjusting cap 100 is adapted for use over the jet plate 96 to provide adjustability to the jet streams of water vapor. The jet adjusting cap 100 includes a circumferential flange 102 for connecting it in a rotatable fashion with flange 103 of the interchangeable nozzle 90. It is preferred that the flanges 102 and 103 be formed such that the jet adjusting cap has a tight fit on the nozzle 90 so that the jet adjusting cap 100 may be maintained in particular positions to provide particular jet adjustment. Note that although a preferred embodiment of a means to adjust the jet stream of vapor is shown and described, it is contemplated that various types of jet adjustment means may be employed.

As stated previously, the present invention contemplates provision of various interchangeable nozzles, such as those shown in FIGS. 6A–6E and referred to as 90A through 90E, shall be provided with the water-vapor apparatus. As depicted in the drawing figure, these various configurations of nozzles may include different sized constrictions, various sized jet holes, and various attachments. For example, FIG. 6E depicts a nozzle 90E adapted to receive a comb attachment 90F. This attachment allows the user to comb his or her hair at the same time as water vapor is impinging on the portion of hair being combed. It is also contemplated to provide various other grooming attachments such as a brush, a hair-pick and the like. The attachment 90E shown in FIG. 6E is a vaporizor mask which is conectable to the flexible hose in the same manner as are nozzles 90A–90D and which is advantageously utilized by a person with a cold, influenza, or allergy by placing the mask over their noze and/or mouth and breathing the water vapor so as to open congested nasal passages Note that when the mask 90E is utilized and the water-vapor producing apparatus is used as a vaporizor for decongesting nasal passages, the dispenser section 24 may be utilized to dispense medicines which will be helpful in treating the user's ailment.

Figure 4:
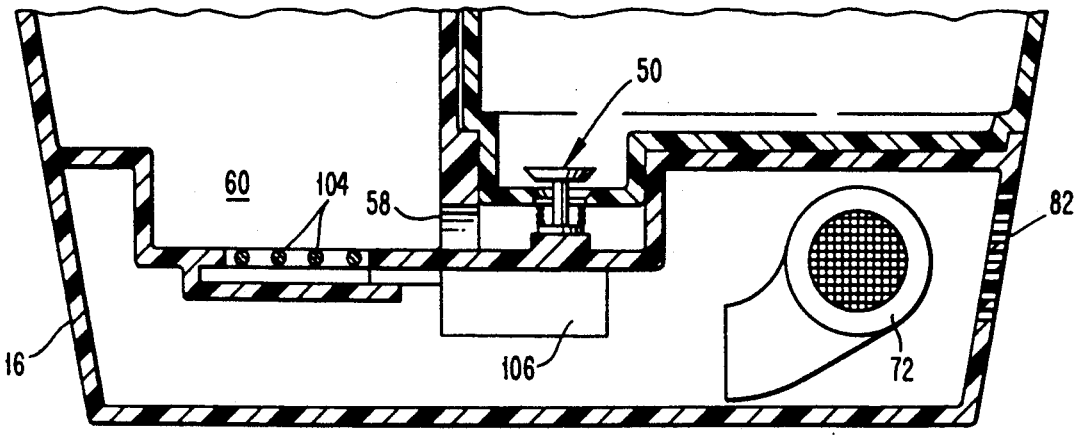
FIG. 4 is a cross-sectional view of a second preferred embodiment of the present invention similar to the view shown in FIG. 2.

A modification to the preferred embodiment shown in FIGS. 1 through 3 is depicted in FIG. 4. The embodiment of FIG. 4 utilizes heating coils 104 in order to produce water vapors from the water as opposed to the ultrasonic vibrator 62 utilized in the previous embodiment. In this steamer apparatus it is not necessary to provide separate heating coils near the fan outlet to heat the airflow, because the heating coils 104 which produce the water vapor are producing it as steam which is by definition heated. Thus, it is apparent that only two manual controls, to adjust the fan 72 and the heating coils 104 will be necessary.

A further modification which may be utilized with either of the first or second embodiments, defines an alternate means of dispensing hair care products into the water reservoir and is shown in FIG. 5. A hair care products container 108 is adapted to fit within an opening 110 in the top of water reservoir chamber 14. A groove 112 is formed about the opening 110 and co-operates with outwardly directed portions of flange 114 of the container 108. In order to maintain the container 108 in its proper position. The inwardly directed portion of flange 114 of the container 108 co-operates with a flange 118 formed at a bottom portion of a plunger 116 adapted to fit within the upper opening of the container 108. The flange 118 co-operates with the inwardly directed portion of flange 114 to keep the plunger 116 from being pushed upwardly out of the container 108 by way of bias force of compression spring 120. The compression spring 120 is connected to the under side of plunger 116 and acts against a bottom portion of the container 108. An outlet port 122 is formed in the bottom wall of the container 108, but flow of hair care products out of the port 122 is restricted by way of a one-way check valve 124. Although the check valve 124 may be of any conventional form, in the preferred embodiment it is contemplated that it be defined by a ball check valve with ball 126 being biased upwardly into the outlet port 122 by way of compression spring 128. This hair care products dispenser 108 may be a disposable container which is filled with hair care products at the factory, or may be a reusable type which includes a fill port 127 and fill cap 129 which covers the fill port. The fill port 127 and fill cap 129 may be arranged at any suitable position about a container 108. In use, in order to dispense hair care products into the water reservoir 14, the plunger 116 is merely pressed downwardly against the bias force of spring 120, thereby causing hair care products to be dispensed out of port 122 against the bias of spring 128. Note that various other hair care dispenser configurations may be utilized.

Figure 7:
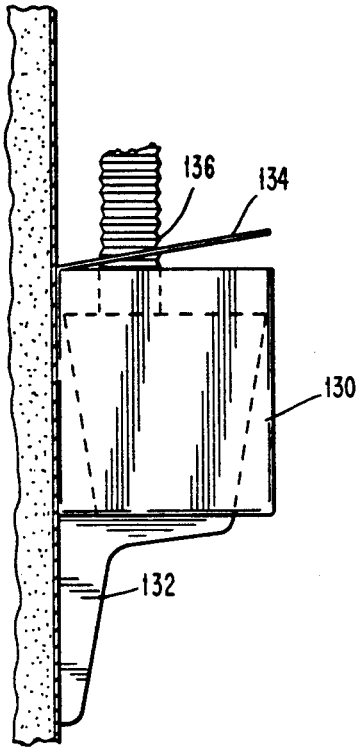
FIG. 7 shows a side elevation view of a first wall mount usable with the present invention.
Figure 8:
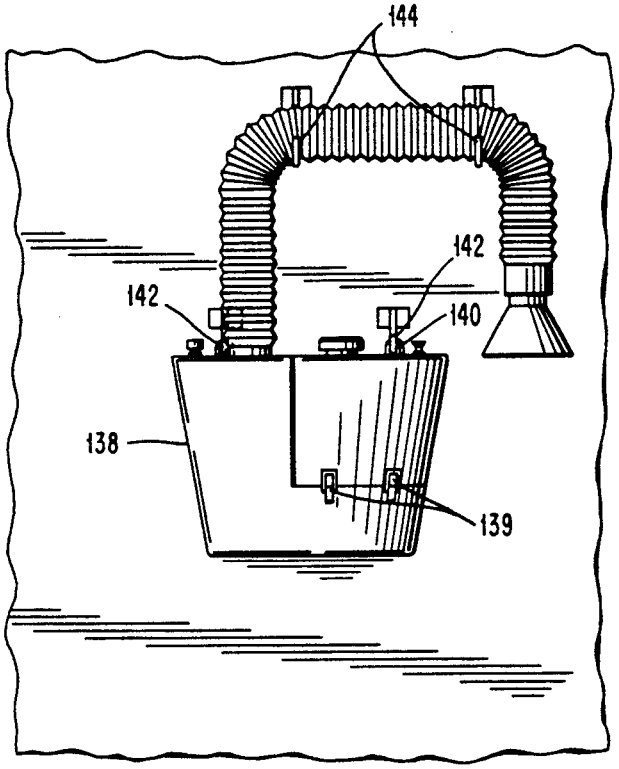
FIG. 8 shows a front elevation view of a modified form of the present invention mounted on the wall in a second preferred manner.
Figure 9:
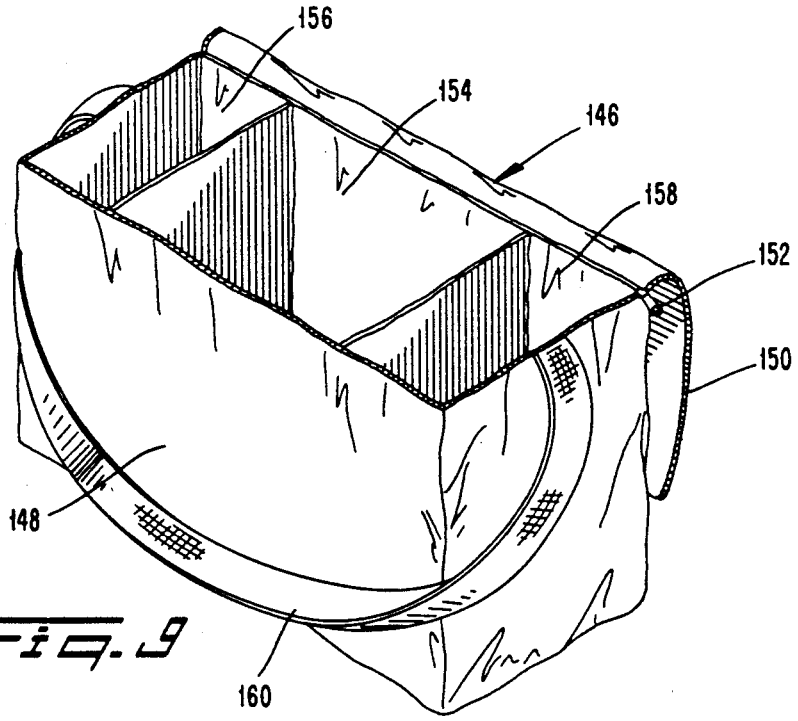
FIG. 9 shows a perspective view of a carrying case for transporting the present steamer apparatus of the present invention.

Various accessories for use with the steamer apparatus are shown in FIGS. 7 through 9. FIG. 7 shows a means to mount the steamer apparatus to a wall, comprising a water resistant rigid box 130 which is supported by way of standard shelf brackets 132. The box is covered by way of lid 134 hinged to the box. In order to allow the apparatus water-vapor hair treatment to be utilized while positioned in the box 130, a lid 134 includes an opening 136 therein such that the flexible hose 120 may extend therethrough out of the box and be available for use. FIG. 8 shows another wall mounting option. In this variation the base section of the apparatus water-vapor hair treatment is preferably formed with a flat rear side 138 such that it will conform with a flat wall. Mounting eyelets 140 are rigidly attached to the rear side of the base section and are adapted for connection with wall mounted mounting hooks 142. Note that because the water reservoir chamber 14 is normally readily removable from the base section, it is necessary to provide clasps 139, so that the water reservoir chamber will be rigidly connected with the base section. Although any suitable clasps may be utilized, it is preferred that clasps such as those used on tool boxes and lunch boxes be utilized. Also note that these clasps may be used in the previously described preferred embodiments of the apparatus water-vapor hair treatment. Hose hooks 144 are also mounted on the wall and are adapted to receive the flexible hose for storage.

Shown in FIG. 9 is a transport case 146 for providing added portability to the water-vapor hair treatment apparatus. The case 146 is defined by a main body preferably formed of soft material such as vinyl, as well as a cover portion 150 which is connected to the main body of the case and is closable by way of a zipper or the like. The transport case 146 includes various compartments such as a main compartment 154 for receipt of the base section of the water-vapor hair treatment apparatus, a second compartment 156 for storage of numerous interchangeable nozzles, and a third compartment 158 for storing the collapsible flexible hose. A carrying strap 160 is also attached to the main body of the case in order to carry the case on one's shoulder.

In operation, the steamer apparatus is utilized by first filling the water reservoir chamber 14 through water inlet 40, placing the water reservoir chamber 14 into the reservoir cutout of the housing 16 such that protrusion 56 forces valve 50 upwardly against the bias force of spring 54. Upon movement of the valve body 50, outlet port 46 is opened and water flows downwardly and through passage 58 into a secondary water chamber 60. When the unit is switched on, the vapor generation means, either ultrasonic vibrator 62 or heating coils 104, is adjusted by way of controls 84 so as to provide the desired amount of water vapor. A fan 72 is also switched on and adjusted so as to provide a desired air flow 74 which will entrain the water vapor produced by the water vapor generation means and deliver the same upwardly into the shroud 66 out of the outlet 68, through the flexible hose 20 and out of the interchangeable nozzle 90 onto the subject's hair. When the ultrasonic vibrator embodiment is utilized to produce vapor, the user may choose a cool vapor or may choose a heated water vapor by actuating and adjusting heating coil 78 to the desired degree. If the embodiment shown in FIG. 4 is utilized, the user may only utilize heated water vapor (i.e. steam). The user may apply hair care products to his or her hair by actuating manual button 32 of hair care dispenser 30 for the embodiment shown in FIG. 1 or pressing down on plunger 116 of hair care dispenser 108 for utilization of the embodiment shown in FIG. 5. When utilizing the ultrasonic vibrator embodiment water-vapor hair treatment apparatus, the type of hair care products which may be used may be dependent on those which will mix with the water and flow through the outlet valve 46 and which will also be sufficiently excited by the ultrasonic vibrator in order to incorporate the hair care product in the fine mist produced In order to utilize the hair care products in the heating coil embodiment of the water-vapor hair treatment apparatus, the hair care product must be one which is volatile in the particular environment and may be vaporized by way of heating. The subject may choose one of the various interchangeable nozzles **90*a* through 90*e*, screw it onto the connection end 92 of the flexible hose and adjust the outlet jets 98 by way of jet adjusting cap member 100**. The flexible hose may then be readily maneuvered to the desired position and to the desired extent. The user may either direct the water vapor onto only a small section of their hair or maneuver it about their entire head of hair.

Although the inventive water-vapor hair treatment apparatus is constructed of plastic in the preferred embodiment, it may be constructed of any suitable material. Plastic is the preferred construction material because it may be molded such that the majority of the components are a single integral unit and because it is strong and lightweight.

As stated previously, the electrical circuitry used to control the vapor generation means, the heating coils and the fan can be of any suitable circuitry known to those skilled in the art which will allow each of the above-described components to be controlled independently. It is contemplated that the electrical current required to run those components may be standard household AC power or battery supplied DC power. It is even contemplated that the heat may be supplied to the vapor generation means by way of solid or liquid fuels such as butane and the like.

Although various embodiments have been shown and described, it will be appreciated that many variations of the present invention may be made without departing from the scope of the invention as defined by the appended claims.

What is claimed is:

1. An apparatus for treating hair with moisture, comprising:

a base member including a water reservoir for holding a predetermined quantity of water, said water reservoir including manually actuable dispensing means for holding a predetermined quantity of hair care products and dispensing said hair care products into said water upon manual actuation of said dispensing means, means for producing vapor from said water or from water containing hair care products, means for connecting said water reservoir to said vapor producing means to allow a flow of water from said water reservoir to said vapor producing means, and outlet means for delivering said vapor out of said vapor producing means;

an elongated flexible hose, having a first end and a second end, detachably connectable to said outlet means at said first end, for use in directing said vapor to a subject's hair; and detachable nozzle means, detachably connectable to said second end of said elongated flexible hose, for creating jets of vapor to apply to said subject's hair.

2. An apparatus for treating hair according to claim 1, wherein said nozzle means includes means for adjusting intensity of said jets of vapor.

3. An apparatus for treating hair according to claim 2, wherein said nozzle means comprises a nozzle body with an input opening, an output opening and a jet plate spanning said output opening, said plate having a plurality of jet producing apertures therein.

4. An apparatus for treating hair according to claim 3, wherein said jet intensity adjusting means comprises a means for effectively enlarging or restricting said jet producing apertures.

5. An apparatus for treating hair according to claim 1, further comprising fan means disposed within said base member for providing a forced air flow to entrain said water vapor and carry said water vapor out said outlet means and through said flexible hose and said nozzle means.

6. An apparatus for treating hair according to claim 5, further comprising heating means for heating said air flow and said water vapor such that said water vapor is warm when applied to said subject's hair.

7. An apparatus for treating hair according to claim 1, wherein said water vapor producing means comprises a heating element means for producing steam from said water.

8. An apparatus for treating hair according to claim 1, wherein said water vapor producing means comprises an ultrasonic vibrating means for atomizing said water.

9. An apparatus for treating hair according to claim 8, further comprising fan means disposed within said base member for providing a forced air flow to entrain said water vapor and carry said water vapor out said outlet means and through said flexible hose and said nozzle means.

10. An apparatus for treating hair according to claim 9, further comprising heating means for heating said flow of air and said water vapor entrained in said flow of air subsequent to said water being atomized by said ultrasonic vibrator.

11. An apparatus for treating hair according to claim 10, wherein said fan means provides said forced air flow at a variable rate and said heating means provides heat at a variable rate, and said apparatus further comprises means for adjustably controlling said rate of forced air flow provided by said fan means; and means for adjustably controlling said heating means so as to control said rate at which heat is provided to said flow of air and said water vapor entrained in said flow of air.

12. An apparatus for treating hair according to claim 1, further comprising means for mounting said base member on a wall.

13. An apparatus for treating hair according to claim 12, wherein said mounting means comprises at least one eyelet attached to said base member, said at least one eyelet being detachably connectable with at least one respective wall mounted hook.

14. An apparatus for treating hair according to claim 13, wherein said mounting means comprises a wall mounted casing, said casing including an open top portion holdingly receivable of said base member, a lid for selectively covering said open top portion, and an opening in said lid through which said flexible hose is extended when said apparatus is in use.

15. An apparatus for treating hair according to claim 1, further comprising a portable carrying case means with a plurality of compartments for storing said base member, said flexible hose and said detachable nozzle means.

16. An apparatus for treating hair according to claim 15, wherein said detachable nozzle means comprises a plurality of variously shaped nozzles individually replaceably connectable to said second end of said flexible hose when in use and stored in one of said plurality of compartments when not in use.

17. An apparatus for treating hair according to claim 1, wherein said detachable nozzle means comprises a plurality of variously shaped nozzles individually replaceably convertable to said second end of said flexible hose.

18. An apparatus for treating hair according to claim 1, wherein said vapor producing means produces vapor from said water or water containing hair care products at a variable rate, and said apparatus further comprises means for adjustably controlling said rate of water vapor by said vapor producing means.

19. An apparatus for treating hair with moisture, comprising:

a water reservoir for holding a predetermined quantity of water, said water reservoir including manually actuable dispensing means for holding a predetermined quantity of hair care products and dispensing said hair care products into said water upon manual actuation of said dispensing means, said water reservoir being detachably receivable within a base member;

a base member, holdingly receivable of said water reservoir, said base member including means for producing vapor from said water or from water containing hair care products, means for connecting said water reservoir to said vapor producing means, when said water reservoir is holdingly received by said base member, to allow a flow of water from said water reservoir to said vapor producing means, and outlet means for delivering said water-vapor out of said vapor producing means; an elongated flexible hose, having a first end and a second end, detachably connectable to said outlet means at said first end, for use in maneuverably directing said water vapor to a desired location; and detachable and interchangeable nozzle means, detachably connectable to said second end of said elongated flexible hose, for causing said water-vapor to impinge upon said desired location in a desired manner.

20. The apparatus according to claim 19, further comprising heating means for heating said water-vapor such that said water-vapor is warm when applied to said desired location.

21. The apparatus according to claim 20, wherein said water-vapor producing means comprises an ultrasonic vibrator.

22. The apparatus according to claim 19, wherein said water-vapor producing means comprises means for heating said water and producing steam therefrom.

* * * * *